US008186278B2

(12) United States Patent
Jager

(10) Patent No.: US 8,186,278 B2
(45) Date of Patent: May 29, 2012

(54) GEAR SWITCH FOR A CONVEYOR ASSEMBLY

(75) Inventor: Todd Jager, Sioux City, IA (US)

(73) Assignee: Industrial Design Fabrication & Installation, Inc., Sioux City, IA (US)

( * ) Notice: Subject to any disclaimer, the term of this patent is extended or adjusted under 35 U.S.C. 154(b) by 21 days.

(21) Appl. No.: 12/185,505

(22) Filed: Aug. 4, 2008

(65) Prior Publication Data

US 2010/0024677 A1 Feb. 4, 2010

(51) Int. Cl.
*E01B 25/26* (2006.01)
*B61B 3/00* (2006.01)

(52) U.S. Cl. ..... 104/101; 104/130.05; 104/172.4

(58) Field of Classification Search ..... 104/91, 104/130.01, 130.02, 130.05, 130.09, 249–251, 104/255, 101, 172.4
See application file for complete search history.

(56) References Cited

U.S. PATENT DOCUMENTS

| | | | | | |
|---|---|---|---|---|---|
| 604,266 | A | * | 5/1898 | Rice et al. | 104/101 |
| 709,590 | A | * | 9/1902 | Werner | 104/101 |
| 721,484 | A | * | 2/1903 | Werner | 104/101 |
| 884,383 | A | * | 4/1908 | Hauptman | 104/101 |
| 1,094,037 | A | * | 4/1914 | Tye | 104/101 |
| 1,144,371 | A | * | 6/1915 | Miller | 104/101 |
| 1,171,748 | A | * | 2/1916 | Normine | 104/101 |
| 2,535,541 | A | * | 12/1950 | Le Fiell | 104/101 |
| 2,873,689 | A | | 2/1959 | Claud-Mantle | |
| 2,944,491 | A | | 7/1960 | Fiell | |
| 3,063,384 | A | | 11/1962 | Sackett | |
| 3,366,076 | A | * | 1/1968 | Ristow | 104/101 |
| 3,503,336 | A | | 3/1970 | Heiberg | |
| 3,538,853 | A | | 11/1970 | Dehne | |
| 3,577,930 | A | | 5/1971 | Rooklyn | |
| 3,662,873 | A | * | 5/1972 | Ross | 104/172.4 |
| 3,760,739 | A | | 9/1973 | Benner | |
| 4,016,818 | A | | 4/1977 | Ellzey | |
| 4,498,399 | A | * | 2/1985 | Wakabayashi | 104/96 |
| 4,646,646 | A | | 3/1987 | Swilley | |
| 4,712,485 | A | * | 12/1987 | Nymark | 104/172.4 |
| 4,993,326 | A | | 2/1991 | Bergemann | |
| 5,152,226 | A | | 10/1992 | Swilley | |
| 5,697,301 | A | | 12/1997 | Sporer | |
| 6,427,831 | B1 | | 8/2002 | Norton | |
| 2009/0038498 | A1 | * | 2/2009 | Jager et al. | 104/91 |

FOREIGN PATENT DOCUMENTS

| | | |
|---|---|---|
| DE | 4314458 | 9/1994 |
| DE | 4314459 | 9/1994 |

* cited by examiner

*Primary Examiner* — S. Joseph Morano
*Assistant Examiner* — Zachary Kuhfuss
(74) *Attorney, Agent, or Firm* — Boardman & Clark LLP

(57) ABSTRACT

A switch assembly for a conveyor is provided. The switch assembly includes a rail section forming a portion of the conveyor assembly. The switch assembly has a first gear assembly pivotable about a first pivot axis and carrying a first gate and a second gear assembly pivotable about a second pivot axis and carrying a second gate, the second pivot axis being positioned below a plane extending perpendicular to the rail section from the first pivot axis. A trolley stop assembly for a conveyor is also provided. The trolley stop includes a body having a first side portion and a second side portion arranged to be disposed on first and second sides of a rail section. A pivot member extends through the body and at least a portion of the rail section. A stop member is carried by an upper portion of the body and a weighted member is also carried by the body arranged to position the stop member for engagement with a trolley. A conveyor assembly including a switch assembly and trolley stop is also disclosed.

8 Claims, 14 Drawing Sheets

GEAR SWITCH FOR A CONVEYOR ASSEMBLY

FIELD OF INVENTION

The present invention relates to switch mechanisms for conveyors, and in particular gear switches and trolley stops for use with conveyor assemblies.

BACKGROUND

It is known to use overhead rail systems along which trolleys travel in order to move goods during processing or manufacture. The systems are used for transporting various types of merchandise, including hanging meat, garments and other products, through manufacturing, warehousing and distribution facilities. One typical overhead conveyer system pushes heavy, metal trolleys along a track system. The trolleys carry loads of products. The overhead rail systems are designed and installed so that goods may be suspended from the trolleys and then moved in different directions along the rail system to transfer the goods from a first location to a second location. Some such systems employ a system of two, parallel tracks or rails; an upper power rail and a lower free rail. The upper rail generally includes a drive chain that engages a component of the trolley, while the trolley's wheels are designed to ride within the free rail. The load supported by the trolley is most often suspended below the level of the free rail.

Oftentimes, overhead rail systems use a rail switching mechanism at points in the track or rail where rails traveling in different directions intersect. The switching mechanism operates to control and direct the movement of the trolleys along various routes of the track system, such as to introduce a turn onto a different rail.

One form of switching mechanism is a gear switch. Current gear switches are typically formed of an assembly including two gear assemblies, each of which are operable to move gates into and out of engagement with a rail section connected thereto. The two gear assemblies in current switching mechanisms are arranged such that they are horizontally spaced apart in a plane which is perpendicular to the rail and at a height which is approximately parallel to each other and the rail. More specifically, the pivot axis of each of the gear assemblies is level and positioned in the same plane.

In a common conveyor assembly using a gear switch mechanism, a power chain is run through a bridge which is often used to connect first and second rail sections forming a portion of the rail switch assembly. In conveyors, projections, often referred to as pusher dogs, are suspended from the drive chain. A pusher dog assembly may be provided for the transportation of products on trolley in a conveyer system. A pusher dog is, generally, a projection that engages and pushes loads along a track or conveyor system. Thus, a power chain or drive chain pusher dog may be engaged to the chain and may be designed to directly engage trolley and push them along the series of interconnected rails. Movement of the trolley is thus accomplished by the mechanized action of the pusher dog on a protruding trolley part. Therefore, the drive chain commonly includes a pusher dog that extends downward from the drive chain and engages a part of the trolley that protrudes above the level of the free track or rail.

Unfortunately, current switching mechanisms, due to the travel path and location of the gear assemblies carrying the gate members, are prone to catch or bind with the pusher dog if the gate is switched at the wrong time. Thus, a high level of precision and timing must be used to switch the rail, or the drive chain must be stopped.

Additionally, in current switching mechanisms, a trolley stop is used to prevent overrun or interference of a trolley with a rail that is not currently being used. A current trolley stop used with such switch mechanisms is formed by a piece or member that is connected on the side of the rail section by a pivot member. At the lower end of the trolley stop is a weight, which causes rotation about the pivot member. Unfortunately, due to the side attachment of the trolley stop to the rail, and the position of the weight, these trolley stops are prone to bind. Moreover, the gate member must be precisely closed, coming over the top of the mechanism, or the gate may become wedged in place in the gate receptor, inhibiting the switching of the rails.

Accordingly, what is needed in the art is a rail switching mechanism that can be switched without binding. There is also a need in the art for a trolley stop for such a switch mechanism that may pivot on center or near center with the rail to stop the trolley or engage the switching mechanism.

SUMMARY OF THE INVENTION

A switch for a conveyor assembly is provided. The switch has a rail section forming a portion of the conveyor assembly. The switch also includes a first gear assembly pivotable about a first pivot axis and carrying a first gate, as well as a second gear assembly pivotable about a second pivot axis and carrying a second gate. The second pivot member is positioned below a plane extending perpendicular to the rail section from the first pivot axis.

A trolley stop for a conveyor assembly is also provided. The trolley stop comprises a body having a first side portion and a second side portion arranged to be disposed on first and second sides of a rail section. A pivot member extends through the body and at least a portion of the rail section. A stop member may be carried by an upper portion of the body. A weight may also be carried by the body, and is arranged to position the stop member for engagement with a trolley.

A conveyor assembly is further provided. The conveyor assembly includes a switch assembly for use in directing items along various paths in a rail system, wherein said switch assembly has a first rail section, a first gear assembly pivotable about a first pivot axis and carrying a first gate, as well as a second gear assembly pivotable about a second pivot axis and carrying a second gate. The second pivot member is positioned below a plane extending perpendicular to the rail section from the first pivot axis. The conveyor assembly also includes a trolley stop positioned on a second rail section having a body with a first side portion and a second side portion arranged to be disposed on first and second sides of the second rail section, a pivot member extending through the body and at least a portion of the second rail section, a stop member carried by an upper portion of the body, and a weight carried by the body arranged to position the stop member for engagement with a trolley when the first gate is engaged with the first rail section.

In an exemplary embodiment of a conveyor assembly having the foregoing components the second pivot axis provides a lower travel path and approximate side-action of the gate which reduces if not eliminates interference with the trolley, pusher dogs and/or drive chain. Furthermore, unlike traditional trolley stops which are often positioned to the side of the rail, the centralized positioning of the rail section in relation to the weighted pivotal movement of the trolley stop assembly permits the trolley stop assembly to rotate smoothly without binding. Other advantages and features may become apparent from the following description, drawings, and claims.

BRIEF DESCRIPTION OF THE DRAWINGS

The invention will now be described, by way of example, with reference to the attached drawings, of which.

DETAILED DESCRIPTION OF PREFERRED EMBODIMENTS

Figure 1:
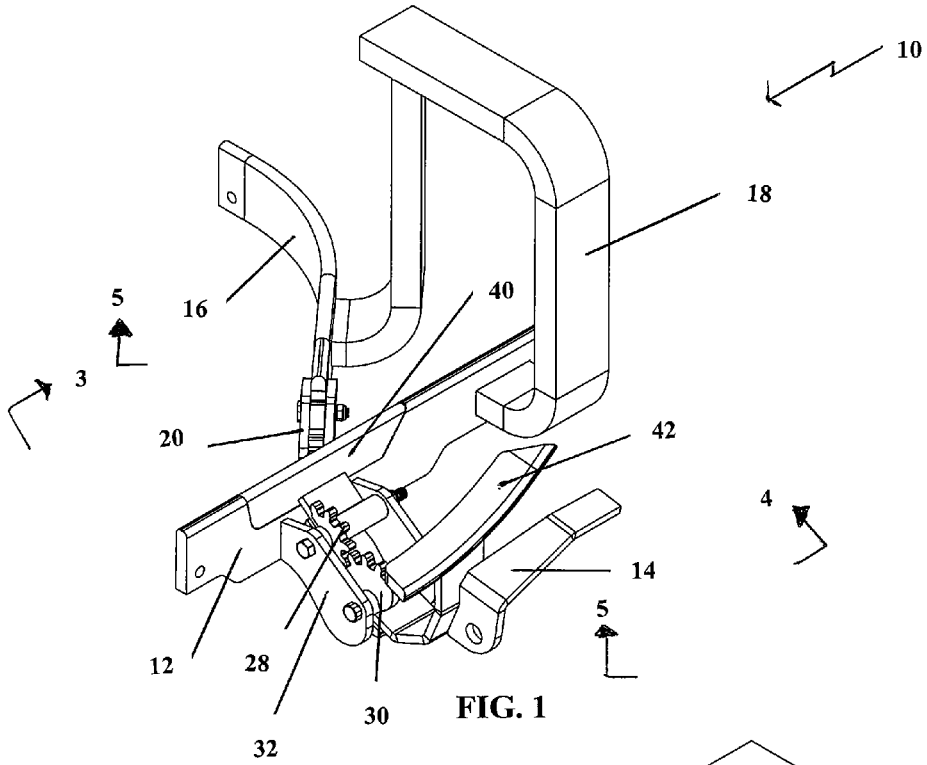
FIG. 1 is a perspective view of a switch assembly according to an exemplary embodiment of the present invention with the switch assembly in a first extreme position and showing a trolley stop on the curved rail section wherein the trolley stop is not positioned for stopping a trolley.

While the disclosure herein is particularly described with regard to overhead trolley conveyors, it will be understood and apparent to those of skill in the art that the present invention has other applications where switching mechanisms are used at points where rails or tracks intersect, in order to direct the objects moving along a track system.

Generally, rail switching mechanisms include a switch mounting which may be suspended from a ceiling or attached to a wall, beam, or other support, and which is used to support the rail sections used in the switching mechanism. The rail sections which are used may be either straight rail sections or curved rail sections, The rail sections may be bolted to the switch mounting, or they may be connected by welding them to the switch mounting. The rail sections used in the switching mechanism also contain one or more gate receptors for receiving the gates which are attached to the rail section. The gate receptors are formed by the absence of a portion of the rail so that a gate can close and be seated in the gate receptor. The opening and closing of the gates controls the movement of trolleys along intersecting rails in the rail system. An exemplary rail switching mechanism is shown in U.S. Pat. No. 8,011.304, which is hereby incorporated by reference in its entirety herein.

The Figures illustrate a switch assembly 10 for a conveyor as described herein. In an exemplary embodiment, the switch assembly 10 is a gear switch assembly in that the mechanism by which tracks or rails are changed is facilitated, at least in part, by a gear or combination of gears or gear assemblies. In FIGS. 1-5, the switch assembly 10 includes or is formed by at least a portion of a first rail 12, which as illustrated may be a straight rail. Thus, as shown, the first rail or first rail section 12 carries or forms a portion of the switch assembly 10, and may include a trolley stop 14 on a portion of the switch assembly. The first rail section 12 is attached to or operably associated with a second rail or second rail section 16 by a bridge 18. The second rail 16 may also carry a trolley stop 20. The second rail section 16 in the illustrated embodiment is a curved rail. While straight and curved rails are specifically illustrated, alternatives would not depart from the overall scope of the present invention.

Figure 6:
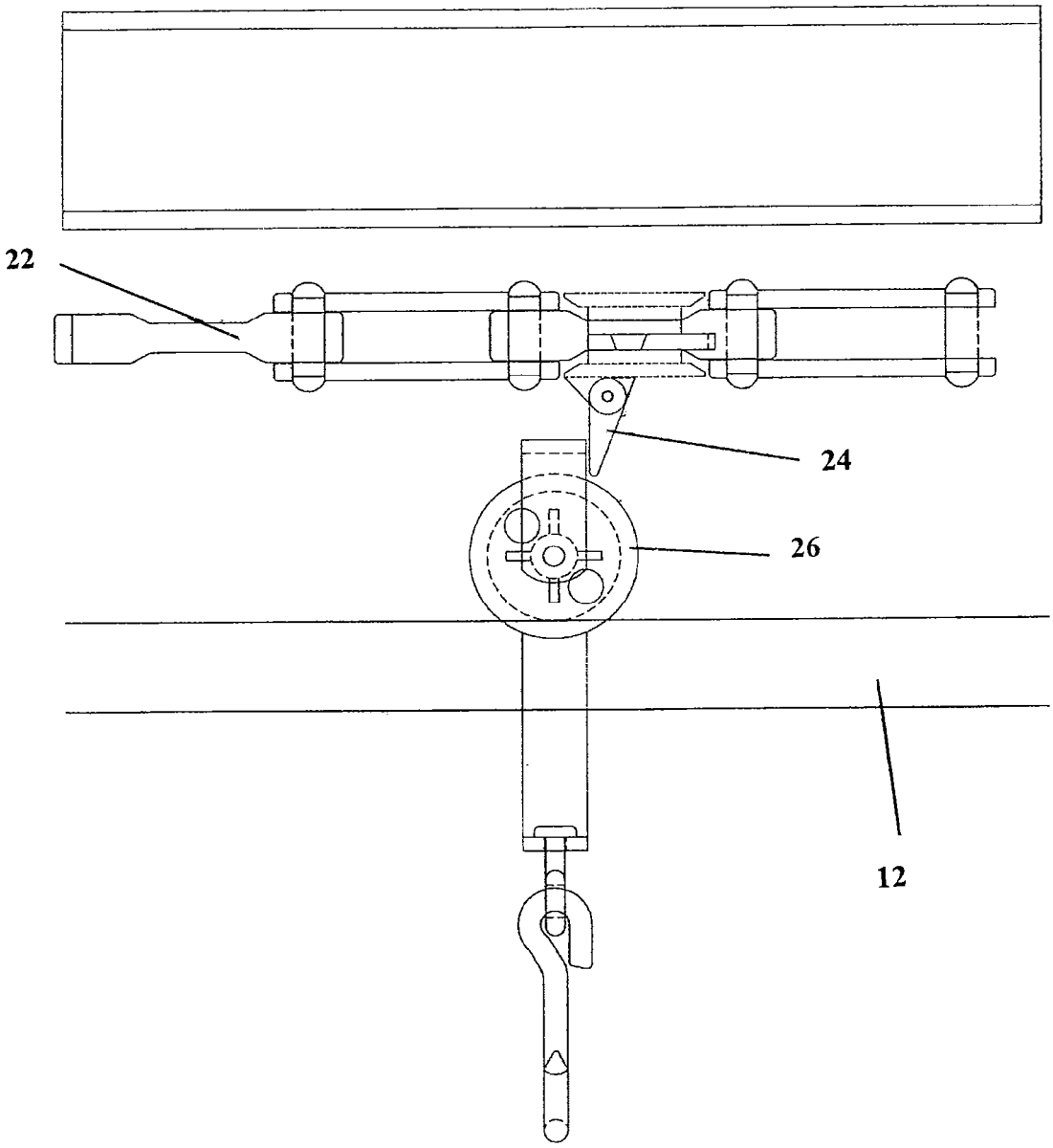
FIG. 6 illustrates an exemplary conveyor assembly for use with the switch assembly of FIG. 1, showing a drive assembly, pusher dog, trolley and rail.
Figure 7:
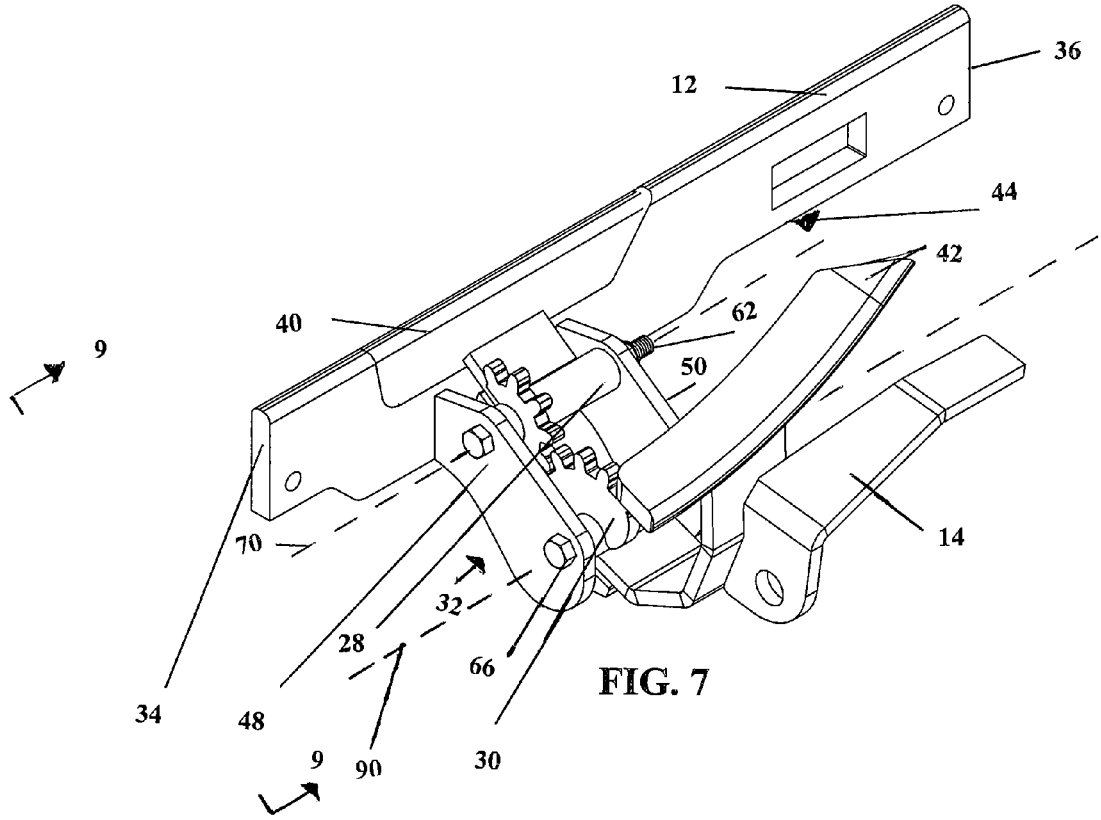
FIG. 7 is a perspective view of a portion of the switch assembly shown in FIG. 1, showing a rail section, mounting portion, and gear assemblies.
Figure 8:
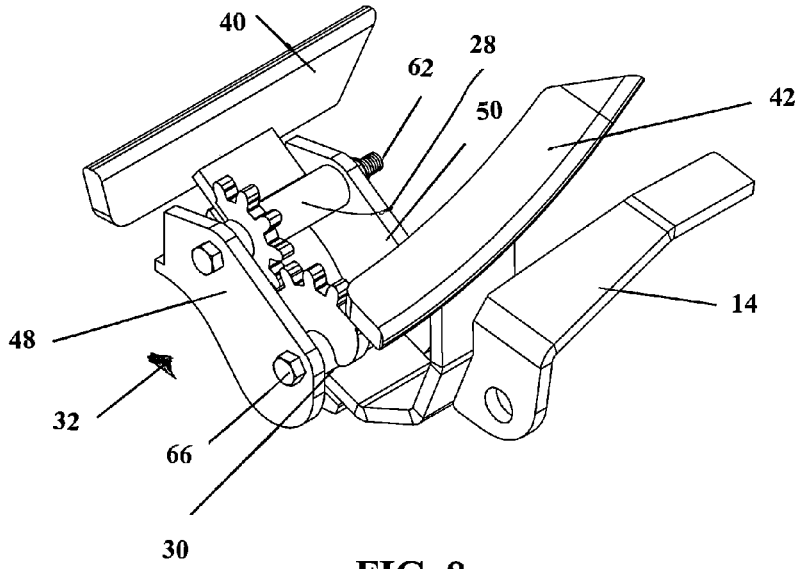
FIG. 8 is a perspective view of a portion of the switch assembly shown in FIG. 1, showing the assembly of FIG. 7 absent the rail section.

The foregoing assembly 10 may be attached to a larger conveyor assembly including a plurality of rail sections, such as two or more rail sections. Additionally, the switch assembly 10 may be used in association with a drive chain 22 or track having one or more pusher dogs 24 thereon. The rail 12 or 16 may also carry a trolley 26 adapted to carry or transport product (see FIG. 6).

The gear switch assembly 10 generally includes a rail section 12 and/or 16, as well as a first gear assembly 28 and a second gear assembly 30 carried by a mounting member 32 carried by the rail section 12. The switch assembly 10 may thus include at least one rail section 12 or a portion of a rail section (see FIGS. 7-15). In FIGS. 7 and 9-12, the first rail section 12 is a straight rail section. The rail section 12 has first and second ends 34, 36 for engagement with additional rail sections, and a gate receptor 38 formed by the absence of a portion of the rail (see FIGS. 11-12) so that a gate 40 or 42 can close and be seated in the gate receptor 38 (see FIG. 7). The gate receptor 38 is positioned between the first and second ends 34, 36.

Figure 13:
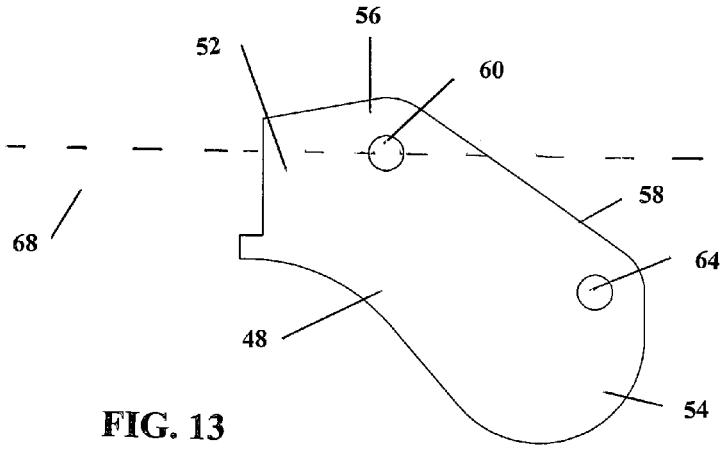
FIG. 13 is an elevation view of a transfer plate for use with the switching assembly shown in FIG. 1.

The rail section 12 also has a first side portion 44 and a second side portion 46. The first side portion 44 carries a mounting member 32 or portion which has first and second gear assemblies 28, 30 (see FIGS. 7-8). In an exemplary embodiment, as shown in FIG. 11, the mounting member 32 is formed by a first transfer plate 48 and a second transfer plate 50 that may be positioned on the first side portion of the rail section. The first transfer plate 48 and second transfer plate 50 may be spaced a distance apart and may be positioned at a location below the gate receptor 38. The plates 48, 50 may be attached by any suitable means, including, but not limited to, welding, tongue and groove, friction fit, and fasteners or combinations thereof. In the illustrated embodiment, as best shown in FIG. 13, each of the first and second plates 48, 50 is formed of a first end 52 for positioning on or near the rail section 12, and a second end 54 arranged to extend a distance away from the rail section. The plates 48, 50 include a first extended portion 56 and a second angled portion or downwardly turned portion 58. The first extended portion 56 includes a first aperture or receptor 60 for a first pivot member 62. The second downwardly turned portion 58 includes a second aperture or receptor 64 for receipt of a second pivot member 66. In an exemplary embodiment, the second aperture 64 is positioned offset from the first aperture 60. More preferably, the second aperture 64 is positioned such that its location is disposed below the plane 68 formed perpendicular to the axis of the first aperture/pivot member 70, and more preferably at or below the plane 72 extending perpendicular from the lower edge 74 of the rail 12 (see FIGS. 9-10).

Figure 14:
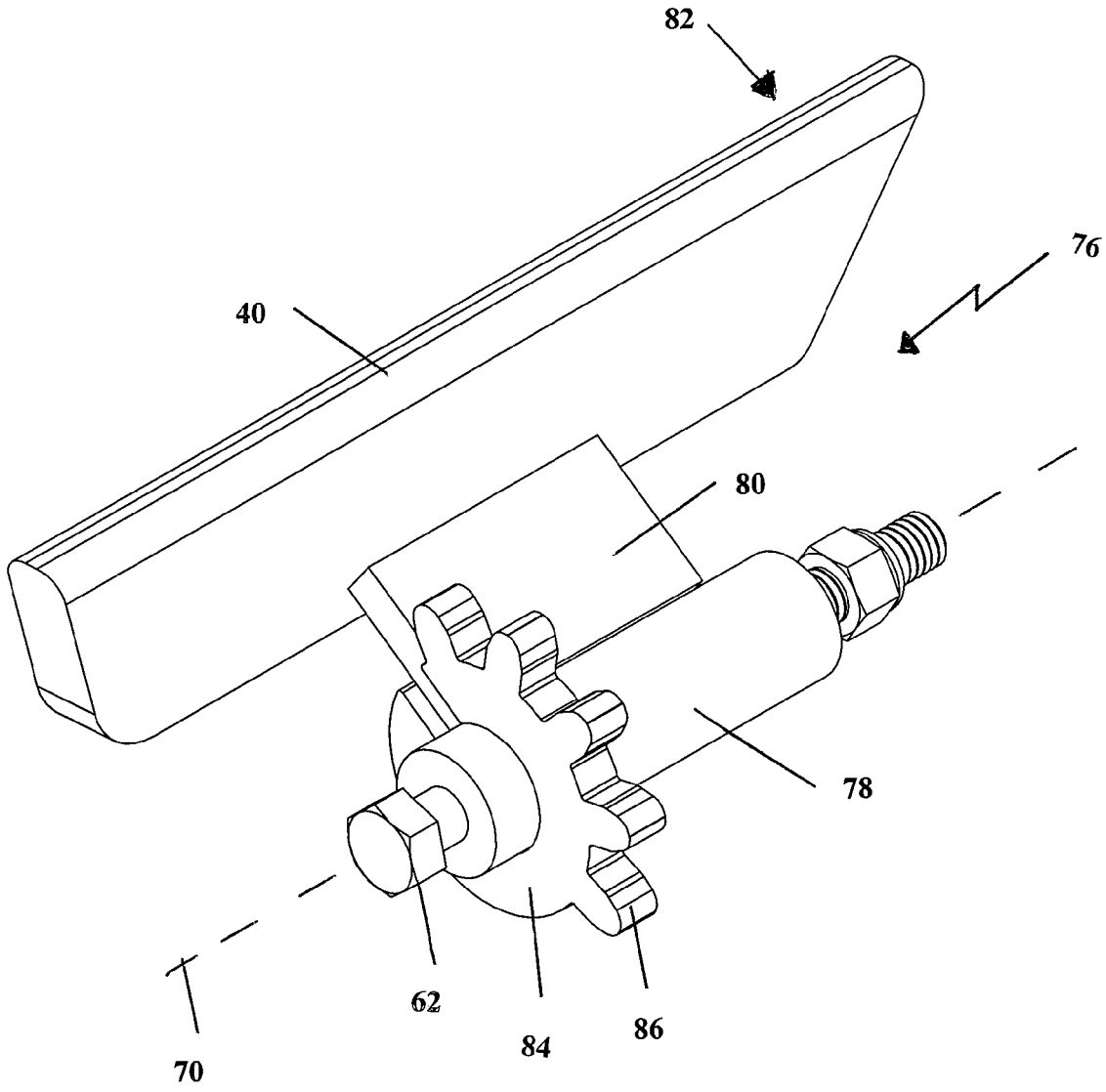
FIG. 14 is a perspective view of a gear assembly of FIG. 8 for use with the switching assembly shown in FIG. 1.
Figure 15:
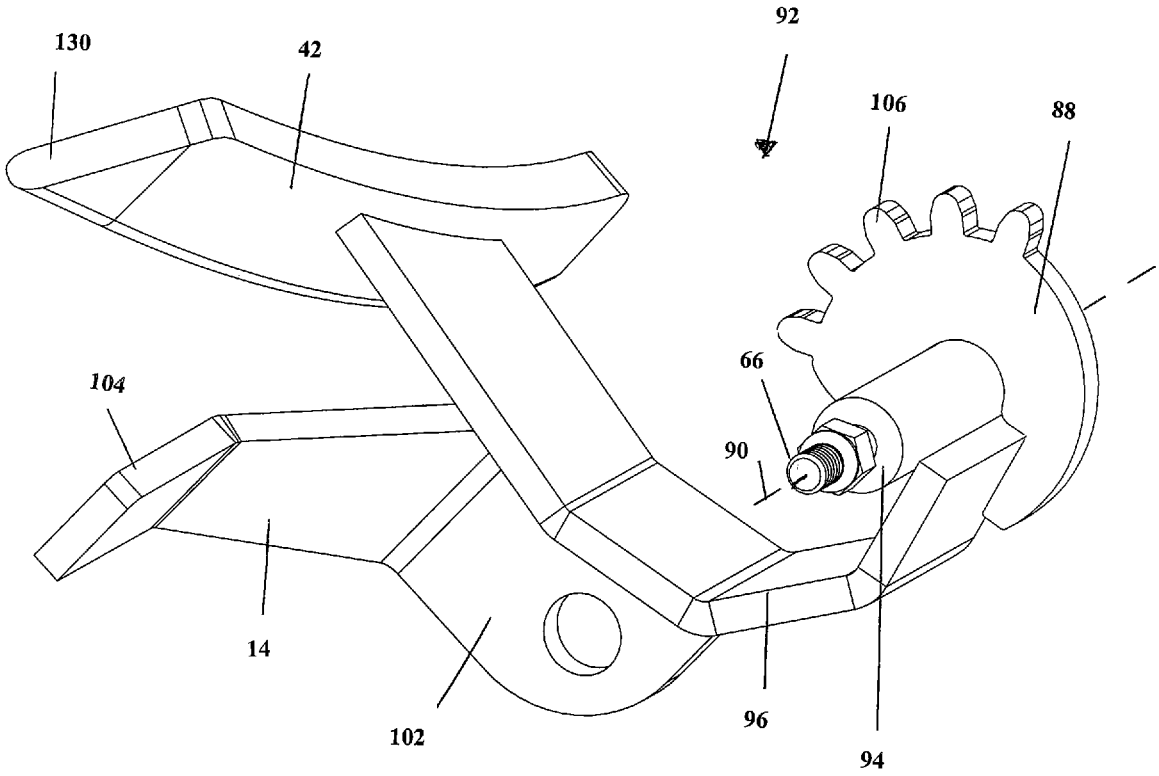
FIG. 15 is a perspective view of an additional gear assembly of FIG. 8 for use with the switching assembly shown in FIG. 1.

The first and second plates 48, 50 carry the first pivotable gear assembly 28. The first gear assembly 28 as shown in FIGS. 14-15 may include pivot member 62 or pin which is rotatably or pivotably received by the first apertures 60 in the first and second plates 48, 50 (see also FIGS. 7-11). Alternatively, the pivot member 62 may be secured in a fixed position in the first and second plates 48, 50. The first pivot member 62 forms first pivot axis 70. The first pivot member 62 may be a bolt or other rod or pin and may include a nut on an end thereof to retain same in place on the switch assembly 10. The first gear assembly 28 also may include a housing 76 which is carried by the first pivot member 62 (FIG. 14). The housing 76 of the exemplary embodiment is formed of a bushing 78 which may be rotatable about the pivot member 62 or may be stationary thereon. The bushing 78 may carry a front pivot spacer 80. Preferably, the front pivot spacer 80 is attached to a portion of the bushing 78 for movement in connection with the pivotal movement of the assembly. The front pivot spacer 80 carries a first gate member 40. The gate member 40 is shaped such that it mates with the gate receptor 38 of the rail section 12 and provides a travel path for a trolley 26 across its top surface 82. As indicated, in the illustrated embodiment, the gate member 40 is a straight gate member. Also carried by the pivot member 62 is a first gear 84, which may be a gear wheel having a plurality of gear teeth 86. In the illustrated embodiment, the first gear 84 is a small gear having a number of teeth 86 sufficient to engage an adjacent gear 88. The first gear 84 is therefore pivotable in connection with the housing 76. The first gear 84 may be attached to the housing 76, integral therewith or separate there from. The pivot member, bushing, pivot spacer, gear and gate portion may be formed by any suitable means, and maybe a single integral component, or more than one component or combinations thereof attached by suitable attachment mechanisms, such as, but not limited to welding, adhesive, fasteners, tongue and groove, and the like.

Figure 2:
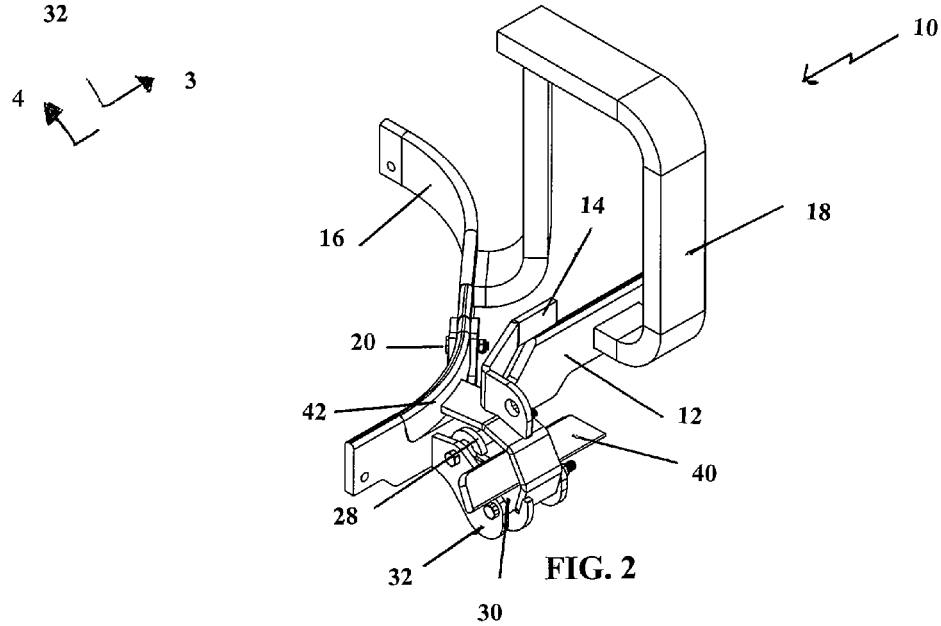
FIG. 2 is a perspective view of the switch assembly shown in FIG. 1 showing the switch assembly in a second extreme position.

The second pivotal gear assembly 30 may be carried by the first and second transfer plates 48, 50. The second gear assembly 30 includes second pivot member 66 or pin which is rotatably or pivotably received by the second apertures 64 in the first and second plates 48, 50 (see FIGS. 7-11). Alternatively, the pivot member 66 may be provided in a fixed position on the plates 48, 50. The second pivot member 66 forms a second pivot axis 90. As seen in FIG. 15, the second pivot member 66 may be a bolt or other rod or pin and may include a nut on an end thereof to retain same in place on the switch assembly 10. The second gear assembly 30 also may include a housing 92 which is carried by the second pivot member 66. The housing 92 of the exemplary embodiment is formed of a bushing 94 which may be rotatable about the pivot member 66 or may be stationary thereon. The bushing 94 may carry a gate lever 96, such as, but not limited to, a curved or shaped gate lever 96. Preferably, the gate lever 96 is attached to a portion of the bushing 94 for movement in connection with the pivotal movement of the assembly. The gate lever 96 carries second gate member 42, which in the illustrated embodiment is a curved gate member. As can be seen in FIG. 15, the gate lever 96 is attached to a side portion of the gate member 42. In this position, the gate lever 96 does not interfere with a trolley 26 which may travel along the rail 12, 16 or gate 42. Also, the gate lever 96 in the exemplary illustrated embodiment is shaped such that it is adapted to place the gate 42 in position and provide clearance for the first gear assembly 28. As shown in FIGS. 2 and 10, the gate lever 96 has a length and degree of curvature that extends over the first gear assembly 28 during both movement and final positioning. The gate member 42 may be shaped such that it mates with the gate receptor 38 of the first rail section 12 and a gate receptor 98 of the second rail section 16 to provide a travel path for a trolley 26 across its top surface or edge 100. Also carried by the second gear assembly 30 is trolley stop 14. In the illustrated embodiment, trolley stop 14 is carried by the gate lever 96, and may be formed of an attachment portion 102 and a stop portion 104 or arm which is arranged to engage a trolley 26 when the second gate portion 42 is in position. The pivot member also carries a second gear 88, which may be a gear wheel having a plurality of gear teeth 106. In the illustrated embodiment, the second gear 88 is a large gear, or a gear which is larger than the first gear 86, and having a number of teeth 106 sufficient to engage an adjacent gear, namely the first gear 86. The second gear 88 is provided in association with housing 92 and may be pivotable in connection therewith. The second gear 88 may be attached to the housing 92, integral with or separate there from. The pivot member, bushing, gate lever, gate portion, gear and trolley stop may be formed by any suitable means, and maybe a single integral component, or more than one component or combination of component attached by suitable attachment mechanisms, such as, but not limited to welding, adhesive, fasteners, tongue and groove, and the like.

Figure 9:
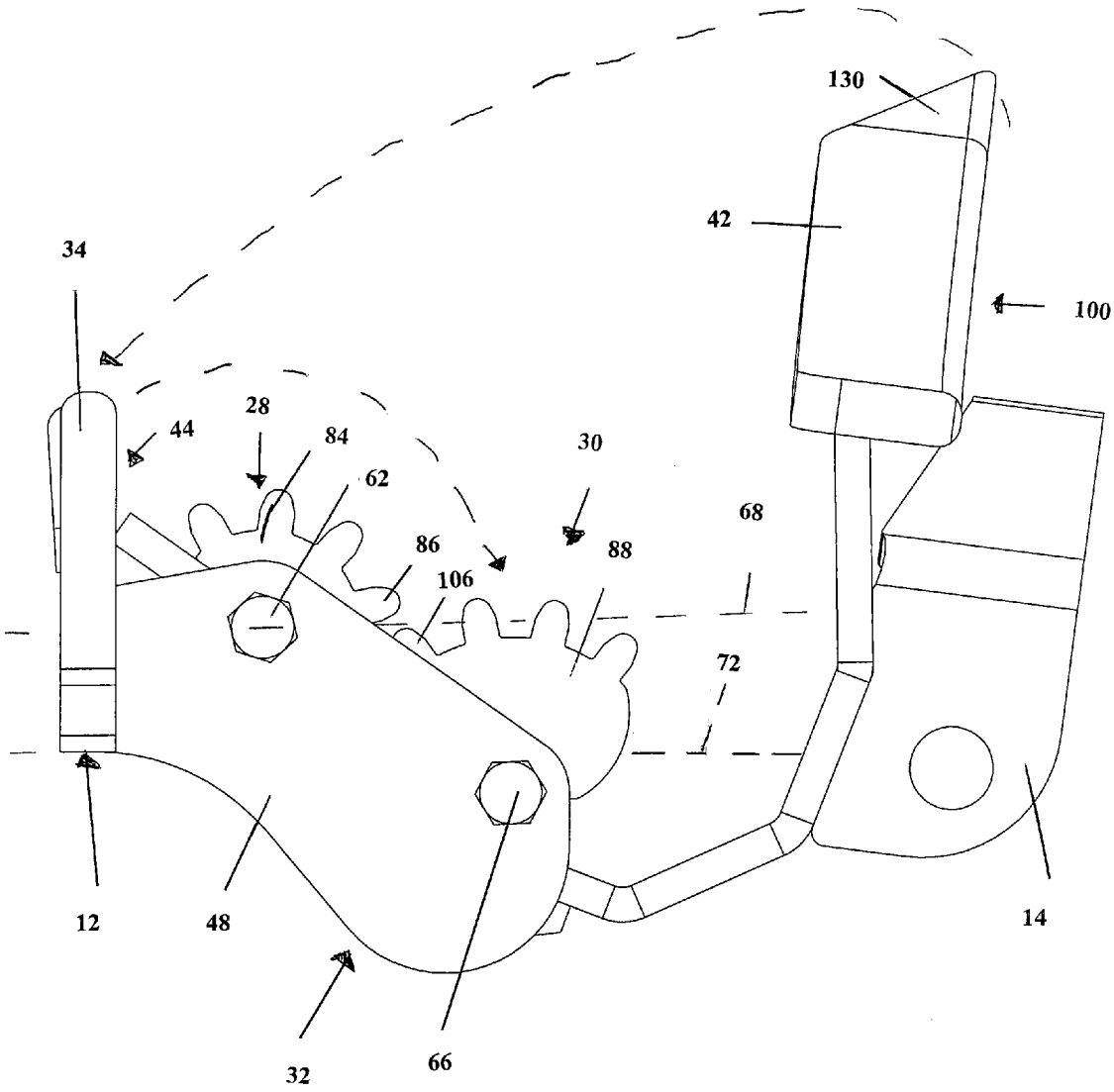
FIG. 9 is an elevation view of a portion of the switch assembly shown in FIG. 1, taken along the line 9-9 of FIG. 7, showing the switch assembly in a first extreme position.
Figure 10:
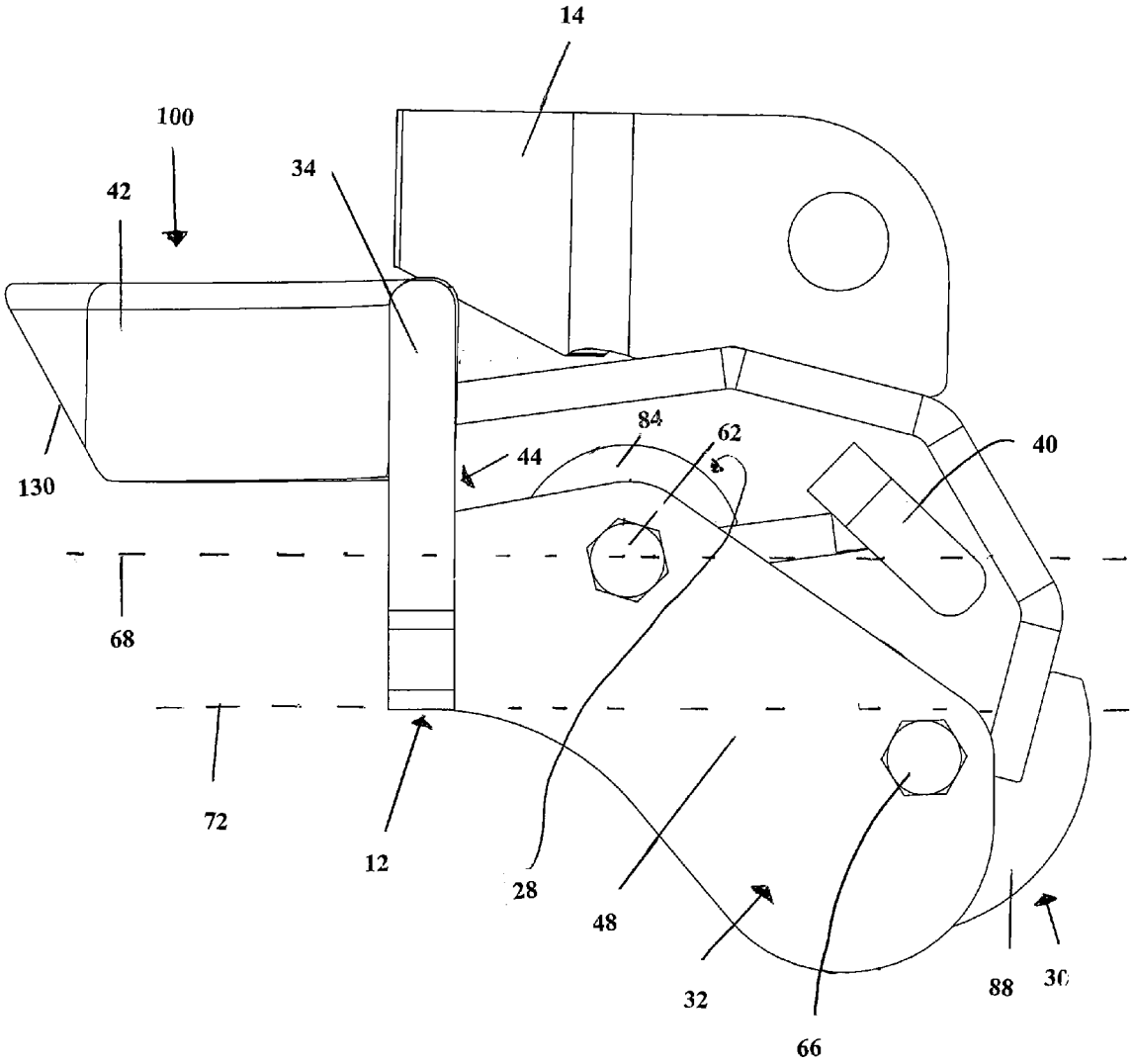
FIG. 10 is an elevation view of a portion of the switch assembly shown in FIG. 1, showing the switch assembly in a second extreme position from that shown in FIG. 9.
Figure 11:
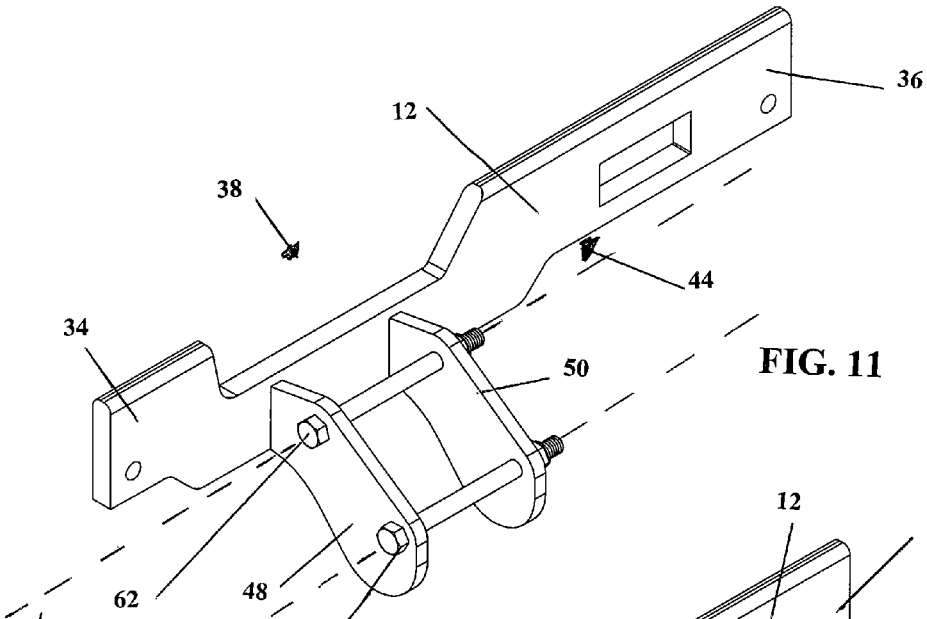
FIG. 11 is a perspective view of a portion of the switch assembly shown in FIG. 1, showing a rail section, mounting portion, and pivot members.
Figure 12:
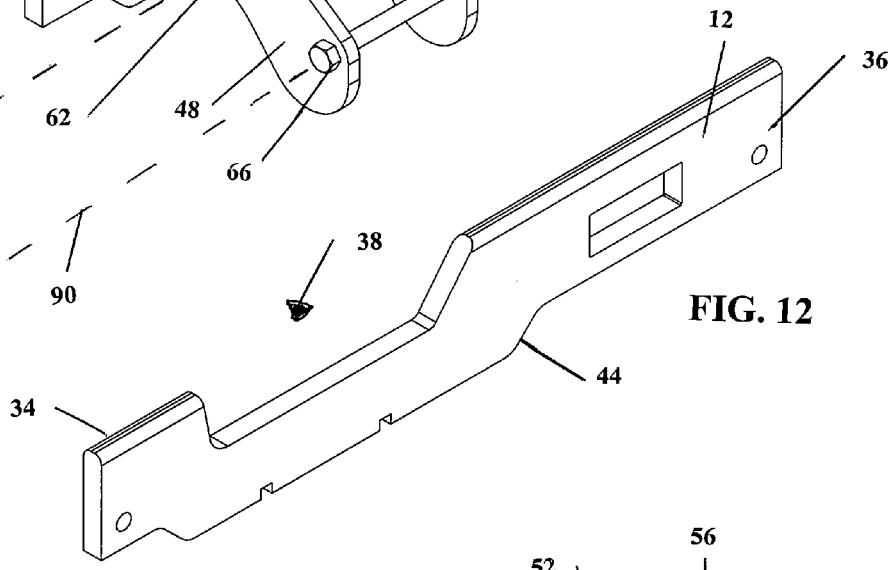
FIG. 12 is a perspective view of a portion of the switch assembly shown in FIG. 1, showing only the rail section of FIG. 11.

In an exemplary embodiment, as best seen in FIGS. 9-10, the second pivot or gear assembly 30 is positioned such that its pivot axis, the second pivot axis 90, is provided in a location below the plane 68 extending from the first pivot or gear assembly axis 70. As can be seen, this plane 68 extends perpendicular to the first rail section 12. Furthermore, the second gear assembly 30 or pivot assembly has a pivot axis 90 which may extend or be provided below the plane 72 extending perpendicular to the rail section 12 from the bottom edge 74 of the rail section.

The foregoing assembly may be formed of any suitable materials for use with conveyor assemblies. In an exemplary embodiment, any one or more of the components of the conveyor assembly, switch assembly or rails described herein may be formed of metal, such as stainless or galvanized steel, aluminum, and the like, as well as plastics, composites, and combinations of any of the foregoing. The components may be integrally formed, or formed separately and connected together, such as by welding, adhesive, tongue and groove, fasteners, and the like. Also, the rail sections, gates, and other components of the assemblies described herein may be formed by any suitable means, and may include CNC cutting, drilling, or otherwise removing of a portion from a solid piece of material. This may include, but is not limited to, use of a laser, a plasma cutting device, or a water jet. Alternative methods of forming the rail and components of the gate are contemplated, including, but not limited to die cut and mold.

The switch assembly 10 may be formed by connecting the first and second transfer plates 48, 50 to the first rail 12, assembling the first and second gear assemblies 28, 30 on the transfer plates 48, 50, such as by inserting the pivot members 62, 66 through the apertures 60, 64 in the transfer plates and into the housings 76, 92 and/or gears 84, 88 of the gear assemblies. The gear assemblies 28, 30 may be formed by attaching the gate member 40 or 42 to the arm or lever 80, 96 and attaching the arm or lever to the housing 76, 92. The first rail section 12 may be attached to the second rail section 16 by, for example, connecting the bridge 18 with the first rail section 12 and the second rail section 16. While a specific arrangement and order of assembly is described, the forgoing is provided by way of example only, and any suitable arrangement or order may be acceptable for purposes of the present invention.

Generally, the rail sections 12 and 16 of the switch assembly 10 may be formed into a larger conveyor assembly by attachment of one or more additional rail sections to the ends of first and second rail sections.

In operation of the exemplary embodiment of the switch assembly 10 shown in FIGS. 1-15, the first gear assembly 28 and second gear assembly 30 cooperate to move the respective first and second gate members 40, 42 between the respective extremes shown in FIGS. 1 and 2 and FIGS. 9 and 10. For example, the first gate member 40 may be positioned such that it is in mating relation with the first rail section 12. Upon operation of the switch 10, which may occur by manual or automated means, the first gear assembly 28 may pivot about the first pivot axis 70. Due to the connection of the first gear 84 and housing 76, which carries the first gate member 40, pivotal rotation causes the first gate member 40 to be lifted from the gate receptor 38 and travel in a radial pattern about the axis 70 of the pivot member, until it arrives at a final resting position. At the same time, the gear teeth 86 of the first gear 84 engage the gear teeth 106 of the second gear 88, causing the pivotal rotational movement of the second gear assembly 30 about the second pivot axis 90 in relation to the first assembly.

More specifically, the second gear 88 pivots or rotates in a direction opposite the first gear 84. Rotation of the second gear 88 about the pivot axis 90 causes the rotation of the associated housing 92, gate lever 96, and second gate member 42 in connection therewith. Rotation moves the second gate member 42 in an approximate radial arc about the second pivot axis 90 to a rest position. The rest position occurs, in the exemplary embodiment, when a gate member 42 is placed in contact with the gate receptor 38, 98 on the first and/or second rail section 12, 16. In the example provided, the second gate member 42 moves into mating position in the gate receptor 38 and may simultaneously engage a mating portion 98 of the second rail section 16. Movement of the second gate member 42 occurs, such that it does not interfere with the first gate member 40 or respective assembly. Thus, in the exemplary embodiment, the first gate 40 moves in an approximate radial motion below the second gate member 40. Furthermore, as a result of the position of the axis 90 of rotation of the second gear assembly 30, the second gate member 40 approaches the rail section 12 and the gate receptor 38 at least partially from a side of the rail, although a degree of motion may extend above the rail section. Rotation of the first and second gear assemblies 28, 30 in the opposite direction causes the disengagement of the second gate member 42 and engagement of the first gate member 40 with the gate receptor 38 on the first rail section 12, in the same manner.

Positioning of the second pivot axis 90 below the first pivot axis 70 of the respective gear assemblies, or positioning of the second pivot axis 90 below the plane 72 of the rail section provides significant advantages. For instance, the second pivot axis provides a lower travel path, and the approximate side-action of the gate reduces, if not eliminates, interference with the trolley, pusher dogs and/or drive chain. In other words, as the second gate member approaches the rail section at least partially from a side thereof, it may avoid the trolley, pusher dogs and chain.

Figure 3:
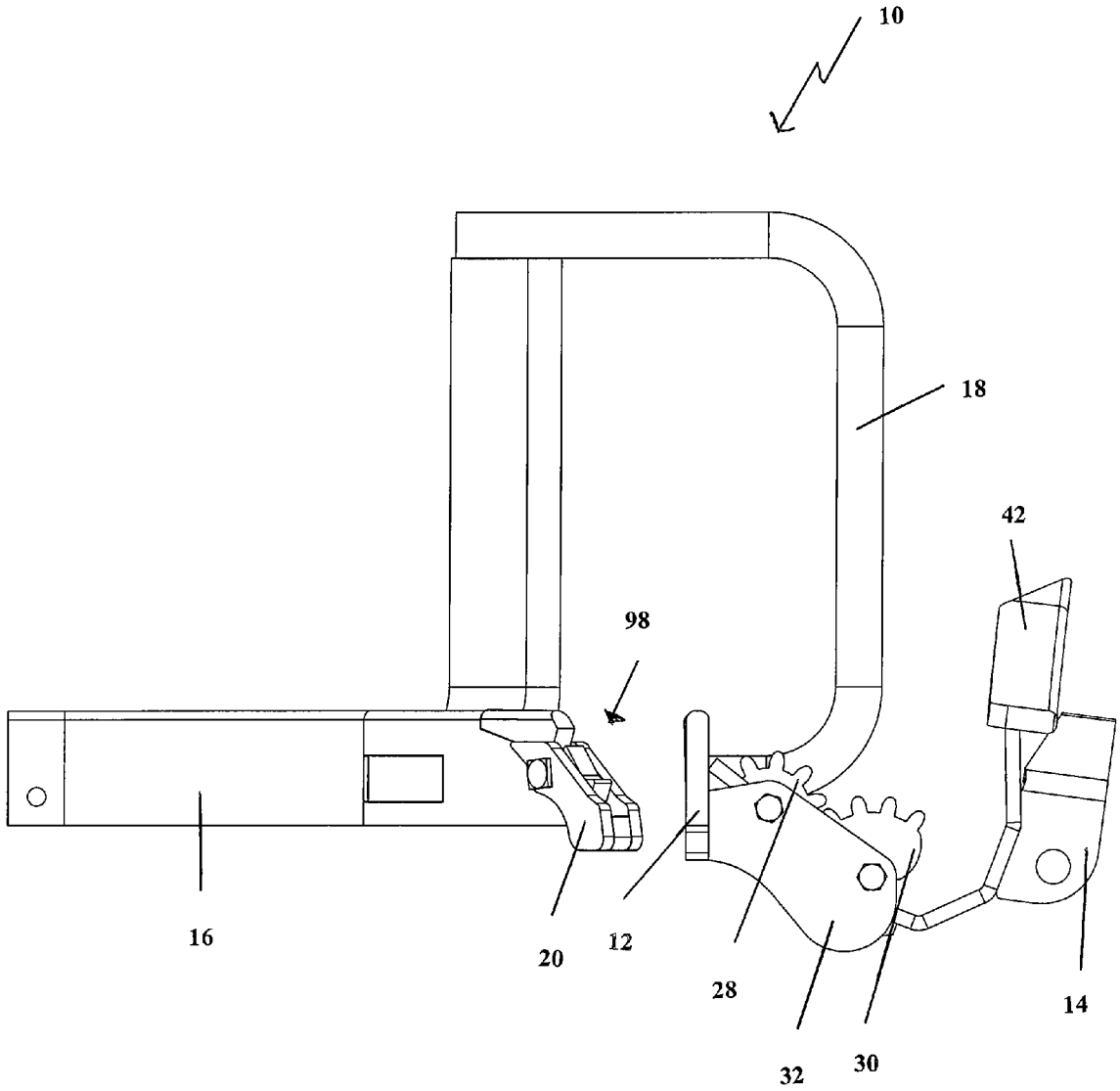
FIG. 3 is an elevation view of the switch assembly shown in FIG. 1, taken from line 3-3 of FIG. 1.
Figure 4:
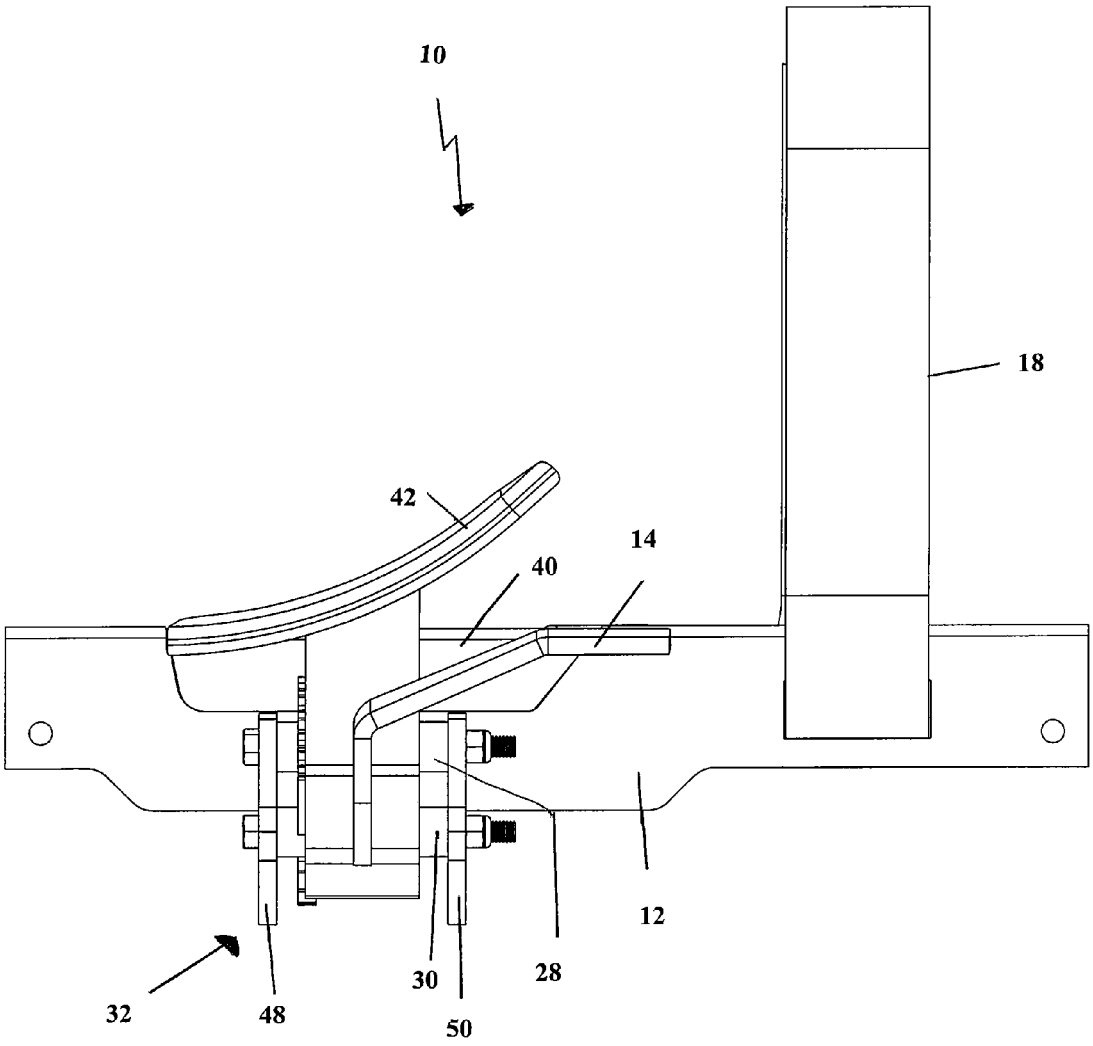
FIG. 4 is an elevation view of the switch assembly shown in FIG. 1, taken from line 4-4 of FIG. 1.
Figure 5:
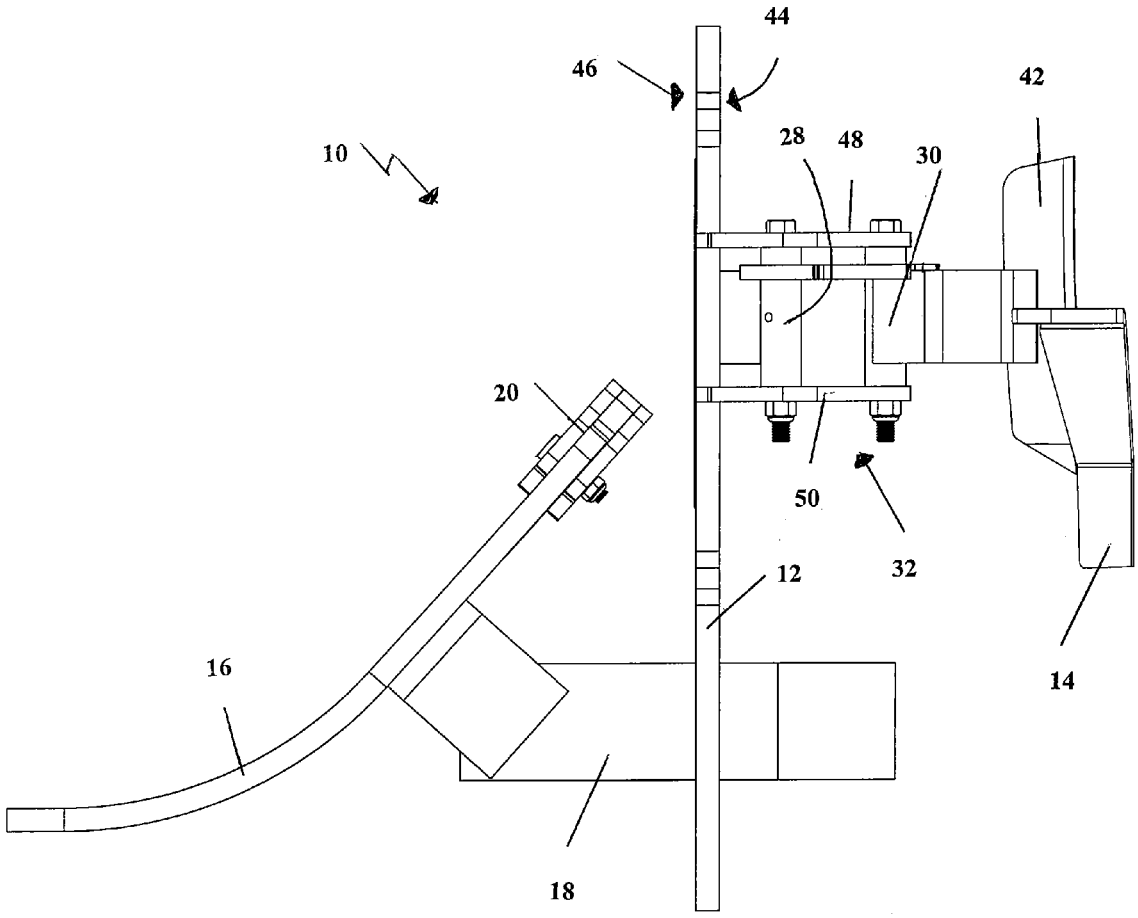
FIG. 5 is a plan view of the switch assembly shown in FIG. 1, taken from line 5-5 of FIG. 1.
Figure 16:
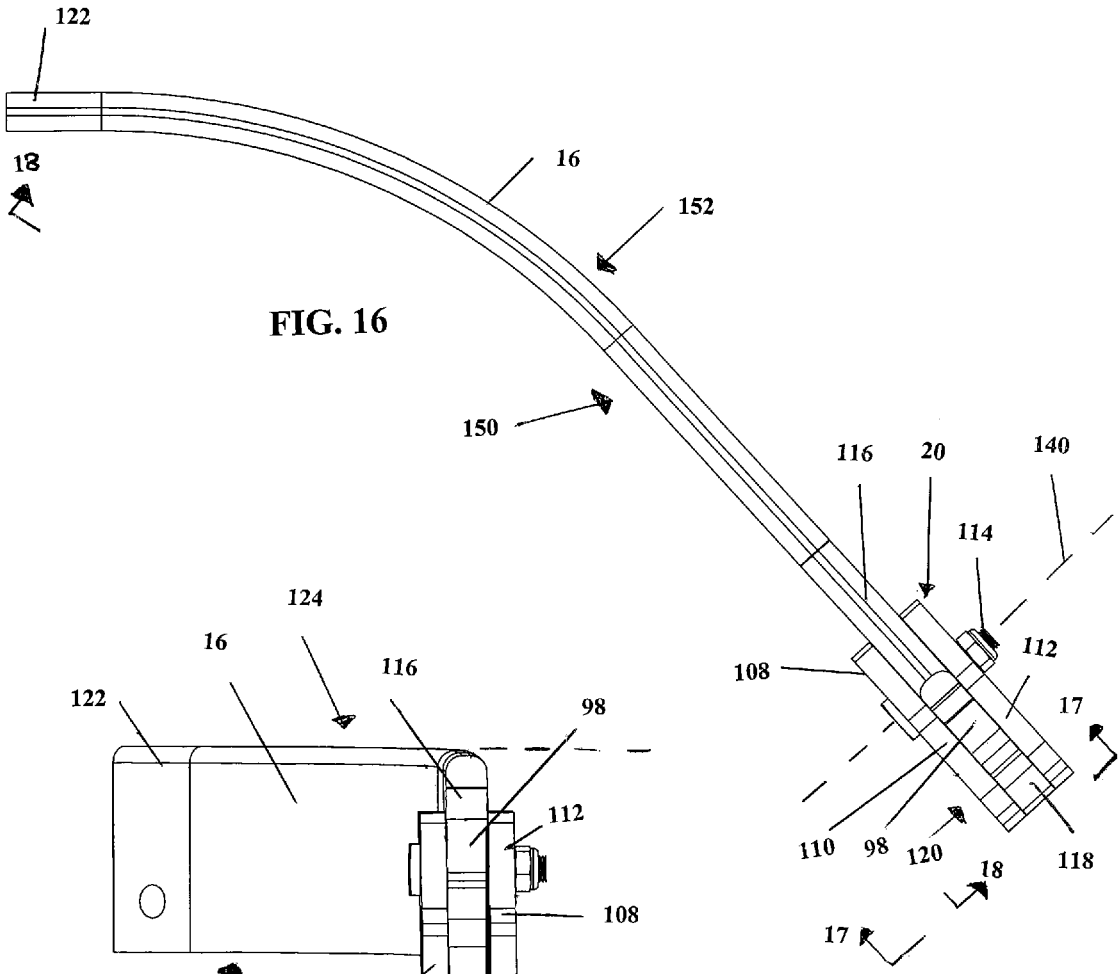
FIG. 16 is a top plan view of a curved rail section and trolley stop for use with the switch assembly shown in FIG. 1.
Figure 17:
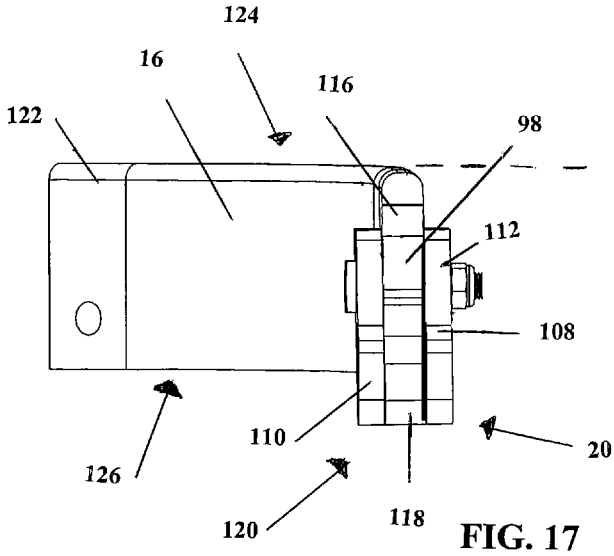
FIG. 17 is an elevation view of a curved rail section and trolley stop for use with the switch assembly shown in FIG. 1, taken along line 17-17 of FIG. 16.

The switch assembly 10 of an exemplary embodiment may also or alternatively be provided with trolley stop assembly 20. As shown in FIGS. 3 and 16-17, the trolley stop assembly 20 in the illustrated embodiment is carried by the second rail section 16, and may be provided in an on-center or near on-center position. Trolley stop assembly 20 may be formed of a body 108 including one or more of a first side plate 110, a second side plate 112, a pivot member 114, a trolley stop member 116, and a weight or weighted member 118.

Figure 18:
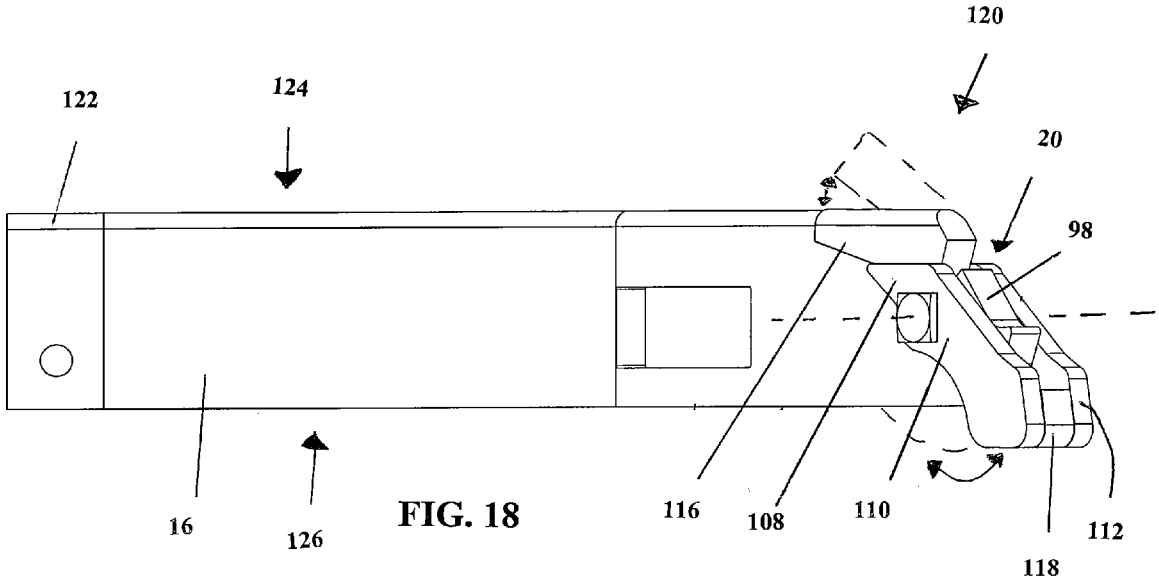
FIG. 18 is an elevation view of a curved rail section and trolley stop for use with the switch assembly shown in FIG. 1, taken along line 18-18 of FIG. 16.
Figure 19:
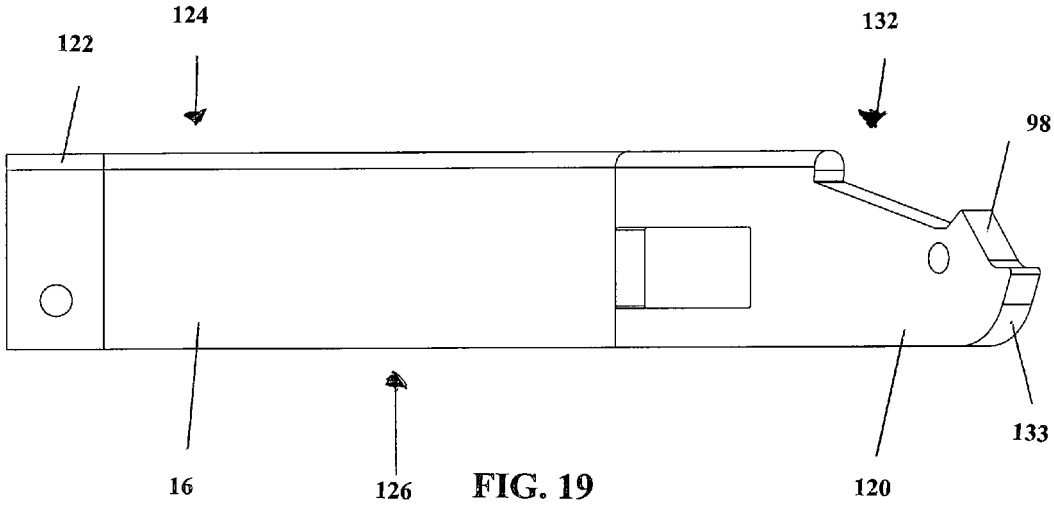
FIG. 19 is an elevation view of a curved rail section shown in FIG. 18 for use with the switch assembly shown in FIG. 1, absent the trolley stop.

Accordingly, as shown in FIGS. 16-17, the second rail section 16 is formed as a curved rail having a first end portion 120, a second end portion 122, a top 124 and a bottom 126. The trolley stop 20 is positioned on or carried by the first end portion 120 of the rail section 16. The first end portion 120, as shown in FIGS. 18-19, may also have a gate engagement portion or receptor portion 98, which may be formed by a recess or cutout or other form which mates with an end portion 130 of the gate member 42 and may serve to at least partially support the gate member 42. The first end portion 120 may also include a section 132 arranged to receive a portion of the stop member 116 and/or a section 133 arranged to receive or permit movement of the weighted member 118 (see FIG. 19).

Figure 20:
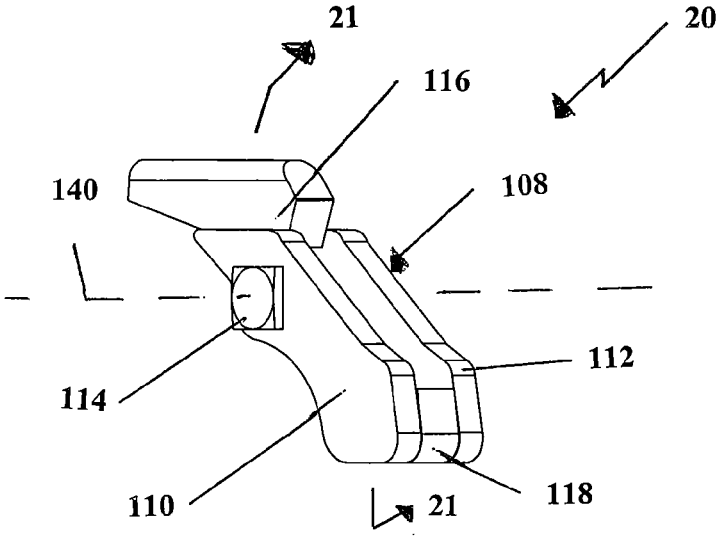
FIG. 20 is a perspective view of a trolley stop shown in FIG. 18 for use with the switch assembly of FIG. 1.
Figure 21:
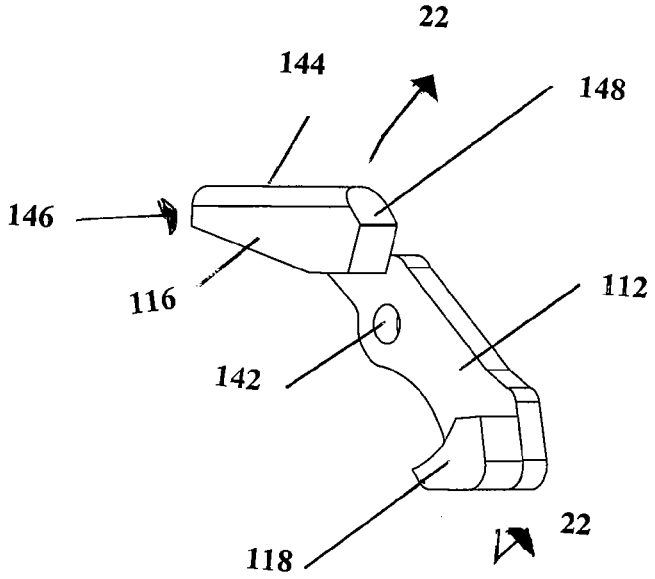
FIG. 21 is a cut away perspective view of the trolley stop shown in FIG. 20 for use with the switch assembly of FIG. 1, taken along line 21-21 of FIG. 20.
Figure 22:
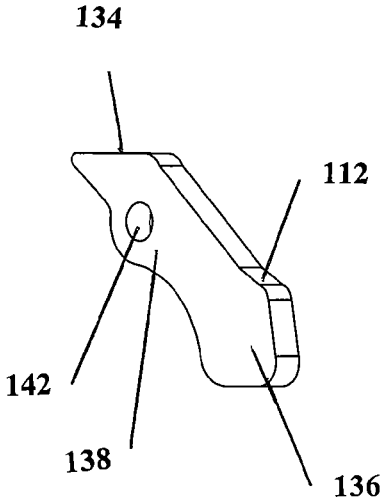
FIG. 22 is a perspective view of a side plate for use with the trolley stop shown in FIG. 20, taken along line 22-22 of FIG. 21.

As indicated and shown in FIGS. 20-22, the trolley stop 20 includes a body 108 having first and second side plates 110, 112 or portions. Each of the side plates 110, 112 is formed of a first portion 134 and a second portion 136. The first portion 134 carries a stop member 116. The second portion 136 carries a weight or weighted member 118. In an exemplary embodiment, the stop member 116 and weighted member 118 are carried by each of the side plates 110, 112. A central portion 138 is provided on each of the side plates for receipt of a pin member, or pivot member 114 forming a pivot axis 140. The central portion 138 may be therefore provided with an aperture 142 or other recess for permitting pass through of a pivot pin 114.

The pivot pin or member 114 is formed of a rod or bolt or other suitable device. The pivot pin 114 extends through the first side plate 110 and the first end 120 of the rail section 16, and may further extend through the second side plate 112. A nut or other attachment mechanism may be used to secure the pivot member 114 in place, although such an attachment mechanism may not be required.

The stop member 116 is carried by a portion of the side plates 110, 112 and in the exemplary embodiment is positioned adjacent or on a first portion 134 of the plates. As can be seen in FIGS. 20-21, the stop member 116 may be carried by the upper portion of each of the side plates in a location between the first and second side plates 110, 112. The stop member 116 may be attached, or operably attached to the side plates, by any suitable means, including but not limited to welding, integral forming or mold, or other attachment mechanism. The stop member 116 may be formed, at least in part, of a rail portion 144. In other words, the stop member 116 may have a portion which corresponds to the top portion of the second rail section 16, enabling a trolley 26 to move there along when the stop member 116 is not positioned for stopping the trolley. The stop member 116, when positioned for stopping the trolley 26, has a portion 146 which extends above the top surface 124 of the second rail section 16, or above a plane formed perpendicular the top surface 124 of the rail section. A portion 148 of the stop member 116, or a portion of the side plates, may be formed and thus adapted to receive a portion of the gate member 42 and cause the movement of the trolley stop assembly 20 in response thereto.

The weighted member 118 for use with the trolley stop 20 is formed by a weighted device sufficient to move the trolley stop 20 from a first position to a second position. In an exemplary embodiment, the weight is sufficient to pivot the trolley stop 20 about the pivot axis 140 of the pivot member 114 to a "trolley stop" position illustrated in dashed lines in FIG. 18, which may occur when the gate member 42 is not engaged with the second rail section 16. The weight may be formed of any suitable material, such as but not limited to, a metal, and may be formed of the material used to form the rail. In the exemplary embodiment shown in FIGS. 20-21, the weight 118 is positioned at the second portion 133 of the first and second side plate 110, 112 and may be carried therebetween. The weighted member 118 may be attached or operably attached to the side plates 110, 112 by any suitable means, including, but not limited to, welding or fasteners or integral forming, such as by mold. As shown in FIG. 21, the weighted member 118 may also be positioned opposite the stop member 116. In an exemplary embodiment, when positioned as shown in FIGS. 17-18, which may be the position of gate member 42 engagement with the second rail section 16, the weight 118 is positioned on a first side of the pivot member 114, and pivoted radially upwardly about the pivot axis 140. In this position, upon removal of the gate member 40, the natural force of gravity causes the weighted member 118 to move downward about the pivot axis 140, in turn causing the upward movement of the stop member 116 shown in dashed lines in FIG. 18.

The foregoing assembly may be formed of any suitable materials for use with conveyor assemblies. In an exemplary embodiment, any one or more of the components of the conveyor assembly, trolley stop assembly or rails described herein may be formed of metal, such as stainless or galvanized steel, aluminum, and the like, as well as plastics, composites, and combinations of any of the foregoing. The components may be integrally formed, or formed separately and connected together, such as by welding, adhesive, tongue and groove, fasteners, and the like.

The trolley stop assembly 20 may be formed by positioning the first and second side plates 110, 112 on first and second sides 150, 152 of the rail 16 and inserting the pivot member 114 through the apertures 142 in the central portion 138 of the side plates 110, 112 and into the end portion 120 of the second rail. The stop member 116 may be attached to the upper or first portion 134 of the side plates and the weighted member 118 may be attached to the lower or second portion 136 of the side plates in the manner previously described. While a specific arrangement and order of assembly is described, the forgoing is provided by way of example only, and any suitable arrangement or order may be acceptable for purposes of the present invention. For example, the stop member 116 and weighted member 118 may be attached to the side plates 110, 112 prior to placing the side plates in connection with the second rail section 16.

Accordingly, in an exemplary embodiment of making and assembling the gear switch 10 and trolley stop 20, a first rail section 12 and a second rail section 16 are provided. A switch assembly 10 may be formed by attachment of a first gear assembly 28 and a second gear assembly 30 to one or more transfer plates 48, 50. The transfer plates may be attached to the first rail section 12. At least one and preferably two gate members 40, 42 may also be provided. Gate members 40, 42 may be attached to the gear assemblies 28, 30 as described in detail hereinabove. A trolley stop 20 may be connected to an end 120 of the second rail section 16 by pivot member 114. The first rail 12 and second rail section 16 may also be connected by attachment of a bridge 18.

In operation of the exemplary embodiment of the trolley stop assembly 20, the weighted member 118 and stop member 116 pivot about the pivot member 114 in response to gate member 42 interaction with the second rail section 16. For example, the second gate member 42 may be positioned such that it is in mating relation with the second rail section 16. In this position, the stop member 116 is positioned such that it does not interfere with trolley 26 movement. Upon operation of the switch assembly 10, which may occur by manual or automated means, the second gate member 42 may be lifted from the gate receptor 98 of the second rail section 16. Free of the gate member 42, which retains the trolley stop member 20 in the position described hereinabove, the weighted member 118 pivotally moves about the pivot axis 140, raising a portion of the stop member 116 above the top portion 124 of the second rail section 16 so as to engage or prevent movement of a trolley 26 there beyond. When the second gate member 42 is lowered again, the gate member 42 presses upon the trolley stop 20 along a portion 148 of the stop member 116 or side plates, causing pivotal movement of the trolley stop assembly 20 in the opposite direction until the gate member 42 reaches its rest position and the stop member 116 is positioned in alignment with the top of the second rail 16.

Unlike traditional trolley stops, which are often positioned to the side of the rail, the use of first and second side plates, and thus, the centralized positioning of the rail section in relation to the pivotal or more specifically, weighted pivotal movement of the trolley stop assembly, permits the trolley stop assembly to rotate smoothly without binding. Furthermore, this positioning enables or enhances the engagement and disengagement of the gate member with the trolley stop, providing consistent non-binding movement and ease of operation.

Presently preferred embodiments of the invention and many of its improvements have been described with a degree of particularity. The previous description is of preferred examples for implementing the invention, and the scope of the invention should not necessarily be limited by this description. Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, angled, and so forth) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

What is claimed is:

1. A conveyor comprising:

a drive chain carrying a pusher dog moveable above a rail and a trolley riding on the rail engagable with the pusher dog for movement along the rail, the drive chain and pusher dog forming a first travel path above the rail and parallel to the rail;

a switch assembly having a rail section secured to the rail, the rail section having a gate receptor adapted to receive a gate, the gate receptor being formed by a recess defined by first and second sidewalls spaced by a lower wall, a first mounting plate and a second mounting plate being laterally spaced apart and secured to a side surface of the rail section between the first and second sidewalls and not extending above the lower wall of the recess, the mounting plates having first and second apertures forming first and second pivot axis that are parallel with the rail, a first gear assembly carried by the first apertures of the mounting plates and pivotable about the first pivot axis, the first gear assembly formed by a first gear having a plurality of gear teeth and a front pivot spacer carrying a first gate, and a second gear assembly carried by the second apertures of the mounting plates and pivotable about the second pivot axis, the second gear assembly having a second gear having a plurality of gear teeth and a gate lever with an arm carrying a second gate, the second gear continuously meshed with the first gear, the second pivot axis being positioned below a plane extending from a lower edge of the rail section perpendicular to the rail section, the second gate being moveable between two extremes including an engaged position with the rail section and an open position in which the second gate is positioned a maximum allowed distance away from the rail, an arc between the two extremes forming a second travel path of the second gate which does not intersect the first travel path, whereby the second gate avoids interference with the pusher dog and drive chain.

2. The switch assembly of claim 1, wherein the gate lever further comprises a bushing surrounding the second pivot axis, a first segment extending from the housing, a second segment integral with the first segment and extending at a first angle from the first segment, a third segment integral with the second segment and extending at a second angle from the second segment, and a fourth segment integral with the third segment and extending at a third angle from the third segment, wherein the fourth segment carries the second gate, and the first angle, second angle, and third angle each range between 0 and 180 degrees.

3. The switch assembly of claim 1, wherein the gate lever, arm and second pivot axis are adapted to move the second gate such that the second gate approaches the rail from approximately a side of the rail.

4. The conveyor of claim 1, wherein the rail section is a first rail section, further comprising a second rail section operably connected to the first rail section, and wherein the switch assembly is arranged to engage the first gate with the first rail section and the second gate with the second rail section.

5. The conveyor of claim 1, wherein the switch assembly is attached to a conveyor assembly having a plurality of rail sections.

6. A switch assembly for a conveyor comprising:

a rail section forming a portion of the conveyor assembly, the rail section having a gate receptor adapted to receive a gate, the gate receptor being formed by a recess defined by first and second sidewalls spaced by a lower wall;

a first mounting plate and a second mounting plate, the first and second mounting plates being laterally spaced apart and secured to a side surface of the rail section between the first and second sidewalls and not extending above the lower wall of the recess, the mounting plates having first and second apertures forming first and second pivot axis that are parallel with the rail section;

movable conveyor components positioned above the rail section aligned with the rail section and forming a first travel path above the rail section and parallel to the rail section;

a first gear assembly formed by a first pivot member secured by the first and second mounting plates to the rail section, a first bushing rotatable on the first pivot member extending between the first and second mounting plates, a front pivot spacer attached to the bushing and carrying a first gate, and a first gear wheel having a plurality of gear teeth, the first gear wheel secured to the bushing for rotation with the bushing about the first pivot axis; and a second gear assembly formed by a second pivot member secured by the first and second mounting plates, a second bushing rotatable on the second pivot member extending between the first and second mounting plates, a gate lever attached to the bushing and carrying a second gate, and a second gear wheel having a plurality of gear teeth, the second gear wheel and the gate lever secured to the bushing for rotation with the bushing about the second pivot axis, the second pivot axis being positioned below a plane extending from a lower edge of the rail section perpendicular to the rail section, and the second gear in rotational engagement with the first gear, the second gate being moveable between two extremes including an engaged position in which the second gate is seated with the rail section and an open position in which the second gate is positioned a maximum allowed distance away from the rail, an arc between the two extremes forming a travel path of the second gate which does not intersect a travel path of movable conveyor components above the rail, whereby the second gate avoids interference with the movable conveyor components above the rail.

7. The switch assembly of claim 6, wherein the gate lever further comprises a first segment extending from the housing, a second segment integral with the first segment and extending at a first angle from the first segment, a third segment integral with the second segment and extending at a second angle from the second segment, and a fourth segment integral with the third segment and extending at a third angle from the third segment, wherein the fourth segment carries the second gate, and the first angle, second angle, and third angle each range between 0 and 180 degrees.

8. The switch assembly of claim 6, wherein the gate lever, arm and second pivot axis are adapted to move the second gate such that the second gate approaches the rail from approximately a side of the rail.

* * * * *